US007291384B2

(12) United States Patent
Obara et al.

(10) Patent No.: US 7,291,384 B2
(45) Date of Patent: Nov. 6, 2007

(54) PISTON RING AND THERMAL SPRAY COATING USED THEREIN, AND METHOD FOR MANUFACTURING THEREOF

(75) Inventors: Ryou Obara, Kashiwazaki (JP); Katsumi Takiguchi, Kashiwazaki (JP); Yukio Hosotsubo, Kashiwazaki (JP)

(73) Assignee: Kabushiki Kaisha Riken, Tokyo (JP)

( * ) Notice: Subject to any disclaimer, the term of this patent is extended or adjusted under 35 U.S.C. 154(b) by 48 days.

(21) Appl. No.: 10/531,423

(22) PCT Filed: Oct. 15, 2003

(86) PCT No.: PCT/JP03/13192

§ 371 (c)(1),
(2), (4) Date: Apr. 15, 2005

(87) PCT Pub. No.: WO2004/035852

PCT Pub. Date: Apr. 29, 2004

(65) Prior Publication Data

US 2006/0040125 A1 Feb. 23, 2006

(30) Foreign Application Priority Data

Oct. 15, 2002 (JP) ..... 2002-300772
Apr. 21, 2003 (JP) ..... 2003-115495

(51) Int. Cl.

| | |
|---|---|
| ***B32B 5/16*** | (2006.01) |
| ***B32B 5/18*** | (2006.01) |
| ***B32B 15/00*** | (2006.01) |
| ***C23C 4/06*** | (2006.01) |
| ***C23C 4/10*** | (2006.01) |

(52) U.S. Cl. ..... 428/315.5; 428/312.8; 428/318.4; 428/539.5; 428/615; 428/679; 428/680; 427/456; 427/455

(58) Field of Classification Search ..... None
See application file for complete search history.

(56) References Cited

U.S. PATENT DOCUMENTS 5,126,104 A * 6/1992 Anand et al. ..... 419/12

(Continued)

FOREIGN PATENT DOCUMENTS

DE 100 61 750 A1 * 6/2002

(Continued)

OTHER PUBLICATIONS

JP 2000-345314 (English Machine Translation), Harada et al., High Hardness Carbide, Cermet Sprayed Coating-Coated Member and its Production, Dec. 2000.*

(Continued)

*Primary Examiner*—Jennifer McNeil
*Assistant Examiner*—Jason Savage
(74) *Attorney, Agent, or Firm*—Browdy and Neimark, PLLC

(57) ABSTRACT

The piston ring of the present invention comprises a thermal spray coating comprising chromium carbide particles having an average particle size of 5 μm or less, and a matrix metal composed of a Ni—Cr alloy or a Ni—Cr alloy and Ni at least on an outer peripheral surface, said thermal spray coating having an average pore diameter of 10 μm or less and a porosity of 8% or less by volume. A piston ring having excellent wear resistance, scuffing resistance and peeling resistance with little attackability on a mating member is obtained by forming a homogeneous thermal spray coating having a fine microstructure.

14 Claims, 9 Drawing Sheets

U.S. PATENT DOCUMENTS

| | | | | |
|---|---|---|---|---|
| 5,960,762 | A * | 10/1999 | Imai | 123/193.4 |
| 6,553,957 | B1 * | 4/2003 | Ishikawa et al. | 123/193.2 |
| 6,562,480 | B1 * | 5/2003 | Stong et al. | 428/546 |
| 6,641,917 | B2 * | 11/2003 | Itsukaichi et al. | 428/402 |
| 6,887,585 | B2 * | 5/2005 | Herbst-Dederichs | 428/546 |
| 2004/0069141 | A1 * | 4/2004 | Herbst-Dederichs | 92/223 |

FOREIGN PATENT DOCUMENTS

| | | |
|---|---|---|
| EP | 1227169 | 7/2002 |
| JP | 60215754 | 10/1985 |
| JP | 03-172681 | 7/1991 |
| JP | 08-210504 | 8/1996 |
| JP | 2000345314 | 12/2000 |

OTHER PUBLICATIONS

Certified English translation of DE 100 61 750 A1, Herbst-Dederichs, Jun. 20, 2002.*

* cited by examiner

10 μm

10 μm

PISTON RING AND THERMAL SPRAY COATING USED THEREIN, AND METHOD FOR MANUFACTURING THEREOF

FIELD OF THE INVENTION

The present invention relates to a piston ring, a thermal spray coating used thereon, and a method for producing such a piston ring, particularly to a piston ring having excellent wear resistance, scuffing resistance and peeling resistance and also low attackability on mating members that it is suitable for internal combustion engines, compressors, etc., a thermal spray coating used thereon, and a method for producing such a piston ring.

BACKGROUND OF THE INVENTION

As internal combustion engines have increasingly higher performance such as higher power, it is demanded that piston rings have excellent wear resistance and scuffing resistance. Thus, outer peripheral surfaces of piston rings made of cast iron or steel have been subjected to surface treatments such as hard chromium plating, nickel composite plating, nitriding, chromium nitride ion plating and thermal spraying, etc. In diesel engines used under particularly severe conditions, thermal spray coatings of cermets are used, but when combined, for instance, with cylinder liners of ferrite-rich, soft cast iron (FC200 to 300) having a tensile strength of 300 MPa or less, the cylinder liners disadvantageously suffer from large wear near top dead points. Accordingly, it is required that thermal spray coatings formed on piston rings have little attackability on mating members with excellent wear resistance and scuffing resistance.

JP 3-172681 A discloses a dense thermal spray coating with good wear resistance, scuffing resistance and peeling resistance, which is formed by plasma-spraying of a mixed powder of $Cr_3C_2$ and Ni—Cr alloy in an inert gas atmosphere under reduced pressure. JP 8-210504 A discloses a piston ring having a thermal spray coating formed at least on its outer peripheral surface by high-velocity oxygen fuel (HVOF) spraying, the thermal spray coating comprising a first layer as an undercoat and a second layer as a topcoat, the first layer comprising 20 to 80% by mass of $Cr_3C_2$ and the balance being a Ni—Cr alloy, and the second layer being made of a cobalt-based or nickel-based sliding material comprising Mo and Cr as main components. Though these thermal spray coatings are considerably improved in wear resistance, scuffing resistance and peeling resistance, their attackability on mating members has not been sufficiently lowered yet.

In conventional thermal spray coatings of chromium carbide/Ni—Cr alloy, pulverized powder having a particle size of several tens of microns is used as thermal spray powder. However, the pulverized powder of a Ni—Cr alloy is thrown against a substrate surface by thermal spraying, forming a flat shape as large Ni—Cr alloy regions as 20 to 40 μm. Thus, the resultant thermal spray coating has an uneven microstructure. When such thermal spray coating is used on a piston ring, the Ni—Cr alloy regions wear first, and the remaining chromium carbide-rich regions abrade mating members. Also, because the coating structure is uneven, the surface roughness of the thermal spray coating cannot be reduced to a desired level or less even by grinding, resulting in wearing a mating cylinder liner. Further, because there are locally extremely hard portions composed only of chromium carbide, an inlaid piston ring having a layer thermally sprayed in a center groove on an outer peripheral surface disadvantageously have steps on groove edges after finish-working of the outer peripheral surface.

OBJECT OF THE INVENTION

Accordingly, an object of the present invention is to provide a piston ring having excellent wear resistance, scuffing resistance and peeling resistance with little attackability on mating members.

Another object of the present invention is to provide a thermal spray coating for such a piston ring.

A further object of the present invention is to provide a method for producing such a piston ring.

DISCLOSURE OF THE INVENTION

As a result of intense research in view of the above objects, the inventors have found that it is possible to form a uniform thermal spray coating having a fine microstructure, (a) by thermally spraying a composite powder comprising chromium carbide particles having desired particle sizes and a Ni—Cr alloy or a Ni—Cr alloy and Ni as main components, or (b) by thermally spraying a combination of such composite powder and another desired metal or alloy powder; and that a piston ring having such a thermal spray coating have excellent wear resistance, scuffing resistance and peeling resistance with little attackability on a mating member. The present invention has been completed based on these findings.

Thus, the first thermal spray coating of the present invention comprises chromium carbide particles having an average particle size of 5 μm or less, and a matrix metal composed of a Ni—Cr alloy or a Ni—Cr alloy and Ni, which has an average pore diameter of 10 μm or less and a porosity of 8% or less by volume. This thermal spray coating preferably has a Vickers hardness of 700 Hv0.1 or more on average, and the standard deviation of the hardness is preferably less than 200 Hv0.1.

The second thermal spray coating of the present invention comprises a first phase having chromium carbide particles dispersed in a matrix metal composed of a Ni—Cr alloy or a Ni—Cr alloy and Ni, and a second phase composed of at least one metal selected from the group consisting of Fe, Mo, Ni, Co, Cr and Cu or an alloy containing the metal, the first phase existing more than the second phase.

The area ratio of the first phase to a surface portion excluding pores (100%) is preferably 60% to 95% in the second thermal spray coating. The chromium carbide particles preferably have an average particle size of 5 μm or less. The second thermal spray coating preferably has an average pore diameter of 10 μm or less and a porosity of 8% or less by volume.

In the first and second thermal spray coatings, the chromium carbide particles preferably have an average particle size of 3 μm or less. The average pore diameter is preferably 5 μm or less, and the porosity is preferably 4% or less by volume. The surface roughness (10-point average roughness Rz) is preferably 4 μm or less. The chromium carbide particles are preferably dendritic and/or non-equiaxial.

The piston ring of the present invention comprises the above first or second thermal spray coating at least on an outer peripheral surface. Accordingly, the first piston ring of the present invention has a thermal spray coating formed at least on an outer peripheral surface, the thermal spray coating comprising chromium carbide particles having an average particle size of 5 μm or less and a matrix metal composed of a Ni—Cr alloy or a Ni—Cr alloy and Ni, and having an average pore diameter of 10 μm or less and a porosity of 8% or less by volume. The second piston ring of the present invention preferably has a thermal spray coating comprising a first phase having chromium carbide particles dispersed in a matrix metal composed of a Ni—Cr alloy or a Ni—Cr alloy and Ni, and a second phase composed of at least one metal selected from the group consisting of Fe, Mo, Ni, Co, Cr and Cu or an alloy containing the metal, the first phase existing more than the second phase.

Remarkable effects are preferably obtained when the piston ring of the present invention is combined with a cylinder liner of cast iron having a tensile strength of 300 MPa or less.

The method for producing a piston ring having the first thermal spray coating of the present invention comprises thermally spraying a composite powder having the chromium carbide particles dispersed in the matrix metal, at least onto an outer peripheral surface of the piston ring.

The method for producing a piston ring having the second thermal spray coating of the present invention comprises thermally spraying a mixed powder of (a) a composite powder having the chromium carbide particles dispersed in the matrix metal, and (b) a metal or alloy powder forming the second phase, at least onto an outer peripheral surface of the piston ring.

The composite powder is preferably obtained by (a) rapidly solidifying a melt of the matrix metal containing the chromium carbide particles, or by (b) granulating and sintering the chromium carbide particles and the matrix metal particles.

The thermal spray method used in the present invention is preferably a high-velocity oxygen fuel (HVOF) spraying method or a high-velocity air fuel (HVAF) spraying method.

THE BEST MODE FOR CARRYING OUT THE INVENTION

[1] Piston Ring

(A) Structure

Figure 1:
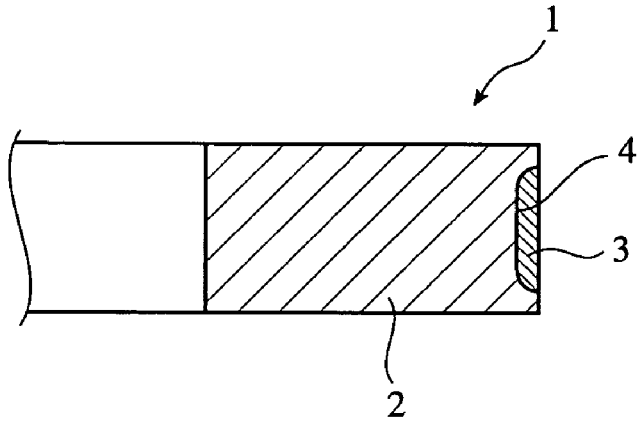
FIG. 1 is a schematic cross-sectional view showing one example of the piston ring, to which the present invention is applicable.
Figure 2:
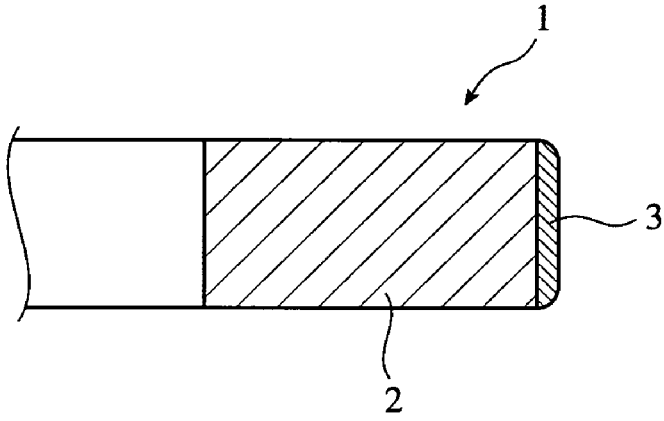
FIG. 2 is a schematic cross-sectional view showing another example of the piston ring, to which the present invention is applicable.

FIG. 1 shows an inlaid piston ring, to which the present invention is applied, and FIG. 2 shows a full-face piston ring, to which the present invention is applied. In either case, the piston ring 1 comprises a substrate 2 made of cast iron or steel, and a thermal spray coating 3 formed at least on an outer peripheral surface of the substrate 2. In the case of the inlaid piston ring 1, a thermal spray coating 3 having wear resistance is formed in a groove 4 of the substrate 2 on its outer peripheral surface. In the case of the full-face piston ring 1, an outer peripheral surface of the substrate 2 is coated with the thermal spray coating 3 having wear resistance. Though the thermal spray coating 3 need only be formed at least on the peripheral slidable surface of the piston ring 1, it may be formed on other portions depending on purposes.

(B) Piston Ring Substrate

The substrate 2 of the piston ring 1 is preferably made of materials having good durability. The preferred materials include steels such as carbon steel, low-alloy steel, martensitic stainless steel, etc., or cast irons such as spheroidal graphite cast iron, etc. When a nitriding treatment is conducted on the substrate 2, it is particularly preferable to use martensitic stainless steel.

(C) Thermal Spray Coating

The composition of the thermal spray coating 3 may comprise (1) chromium carbide particles and a matrix metal composed of a Ni—Cr alloy or a Ni—Cr alloy and Ni (first thermal spray coating), or (2) a first phase comprising chromium carbide particles and a matrix metal composed of a Ni—Cr alloy or a Ni—Cr alloy and Ni, and a second phase composed of at least one metal selected from the group consisting of Fe, Mo, Ni, Co, Cr and Cu or an alloy containing the metal (second thermal spray coating).

(1) First Thermal Spray Coating

The first thermal spray coating comprises chromium carbide particles and a Ni—Cr alloy or a Ni—Cr alloy and Ni. Because the chromium carbide particles have hardness suitable for a slidable member, the thermal spray coating containing chromium carbide particles has excellent wear resistance and scuffing resistance with little attackability on a mating member. Because the Ni—Cr alloy is well bonded to the piston ring substrate and the chromium carbide particles, it improves the bonding of the thermal spray coating to the piston ring substrate, namely a peeling resistance.

(a) Chromium Carbide Particles

Though not restrictive, specific examples of the chromium carbides include $Cr_2C$, $Cr_3C_2$, $Cr_7C_3$ and $Cr_{23}C_6$. They may be used alone or in combination.

To reduce attackability on a mating member, the chromium carbide particles have an average particle size of 5 μm or less. When the average particle size of the chromium carbide particles exceeds 5 μm, the chromium carbide particles function as abrasive grains, resulting in larger wear in the mating member. The preferable average particle size of the chromium carbide particles is 3 μm or less. Incidentally, the lower limit of the average particle size of the chromium carbide particles may be 1 μm.

When the chromium carbide particles function as abrasive grains projecting from the thermal spray coating surface or free abrasive grains debonded from the thermal spray coating, the piston ring wears (abrades) the mating member (cylinder liner). The chromium carbide particles preferably have fine, round shapes to prevent them from functioning as abrasive grains, or dendritic and/or non-equiaxial shapes to prevent them from debonding from the thermal spray coating.

(b) Mixture Ratio

Though the amount of chromium carbide particles contained may be properly selected depending on the required coating properties, it is preferably within a range of 30% to 90% by volume to a portion of the thermal spray coating excluding pores. When the amount of chromium carbide particles is less than 30% by volume, there are larger percentages of a Ni—Cr alloy (or a Ni—Cr alloy and Ni), causing adhesive wear and thus resulting in larger wear of the mating member. On the other hand, when the amount of chromium carbide particles exceeds 90% by volume, there is a few binder component of a Ni—Cr alloy (or a Ni—Cr alloy and Ni), and therefore many chromium carbide particles debond from the thermal spray coating, causing abrasive wear and thus resulting in more wear of the mating member. The more preferred amount of the chromium carbide particles is 30% to 80% by volume.

(c) Properties

It is necessary that the first thermal spray coating has an average pore diameter of 10 μm or less and a porosity of 8% or less by volume per the entire thermal spray coating. When the average diameter of pores exceeds 10 μm, or when the porosity exceeds 8% by volume, pores function as sites, at which chromium carbide particles debond from the coating, during sliding. The average pore diameter is preferably 5 μm or less, and the porosity is preferably 4% or less by volume. Particularly when a nitriding treatment is conducted after the formation of the thermal spray coating, the porosity of the thermal spray coating is preferably 1.5% or less by volume, to prevent a brittle nitride layer (so-called white layer) from being formed on a substrate surface in contact with the thermal spray coating, which leads to decrease in the adhesion of the thermal spray coating.

Figure 5:
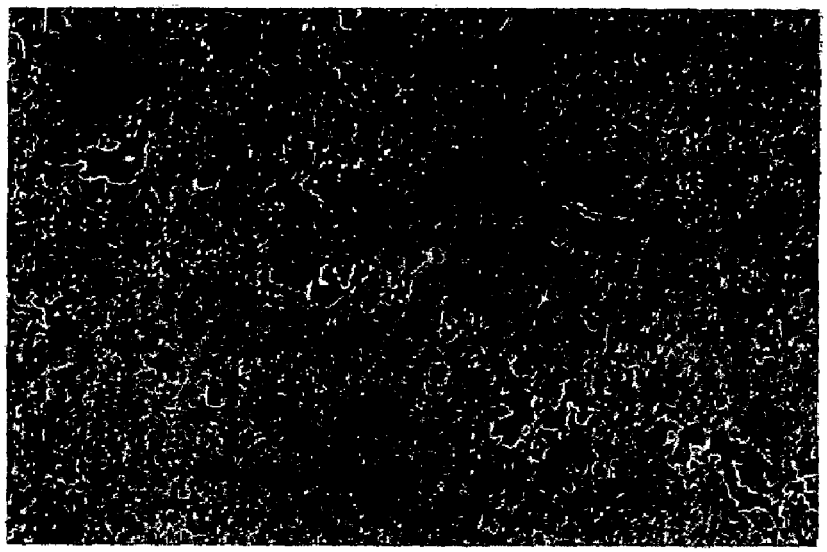
FIG. 5 is a scanning electron photomicrograph (×1000) showing the microstructure of the thermal spray coating in Example 1.
Figure 9:
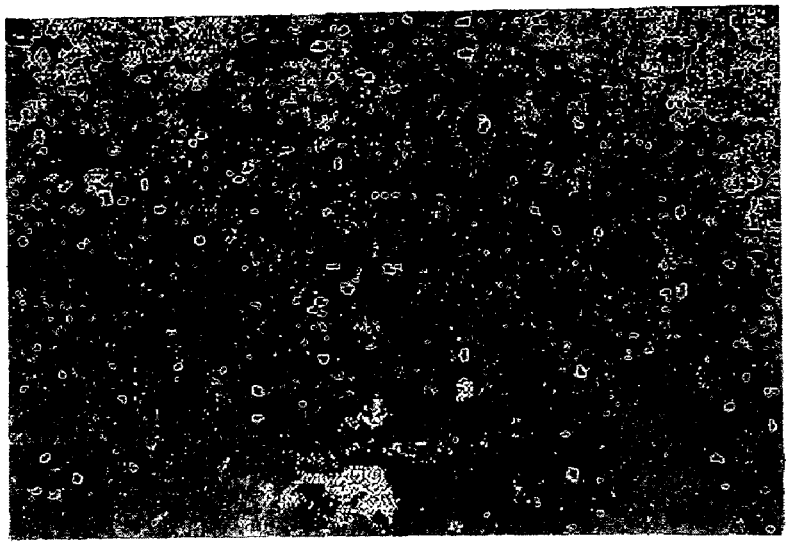
FIG. 9 is a scanning electron photomicrograph (×1000) showing the microstructure of the thermal spray coating formed in Example 3.

Because the first thermal spray coating has a homogeneous microstructure as shown in the scanning electron photomicrographs (×1000) of FIGS. 5 and 9, its hardness is also uniform. The thermal spray coating having uniform microstructure and hardness has such an excellent wear resistance that it can suppress the wear of the cylinder liner. The hardness of the thermal spray coating is expressed by Vickers hardness according to JIS Z 2244. The average hardness of the thermal spray coating measured at 20 randomly selected points under a load of 100 g is preferably 700 Hv0.1 or more, with its standard deviation of less than 200 Hv0.1. The average hardness of the thermal spray coating is more preferably 800 to 1000 Hv0.1, with its standard deviation of less than 150 Hv0.1, further preferably less than 100 Hv0.1.

(2) Second Thermal Spray Coating

The second thermal spray coating comprises a first phase having chromium carbide particles dispersed in a matrix metal composed of a Ni—Cr alloy or a Ni—Cr alloy and Ni, and a second phase composed of at least one metal selected from the group consisting of Fe, Mo, Ni, Co, Cr and Cu or an alloy containing the metal, the first phase existing more than the second phase.

(a) First Phase

The first phase may have the same composition as that of the first thermal spray coating. Namely, the first phase comprises chromium carbide particles dispersed in a matrix metal of a Ni—Cr alloy or a Ni—Cr alloy and Ni. The content of the chromium carbide particles in the first phase is preferably 30% to 90% by volume, more preferably 30% to 80% by volume, like the first thermal spray coating.

(b) Metal or Alloy in Second Phase

Metals or alloys in the second phase are preferably Fe, Mo, Ni, Co, Cr, Cu, a Ni—Cr alloy, a Ni—Al alloy, a Fe—Cr—Ni—Mo—Co alloy, a Cu—Al alloy, a Co—Mo—Cr alloy, etc. Powders of Fe, Mo, Ni, Co, Cr, Cu or alloys thereof are softened and strongly adhered to the first phase when thermally sprayed by a HVOF method or a HVAF method. Accordingly, the metal or alloy powder in the second phase function as a binder for the composite powder, thereby increasing the bonding strength of thermally sprayed powders.

(c) Ratio of First Phase to Second Phase

The area ratio of the first phase occupying the second thermal spray coating is preferably 60% to 95%, more preferably 70% to 90%, per the area (100%) of a portion of the thermal spray coating excluding pores (first phase+second phase).

(d) Properties

Though not restrictive, the second thermal spray coating may have the same microstructure and properties as those of the first thermal spray coating. Namely, the second thermal spray coating preferably has an average pore diameter of 10 μm or less and porosity of 8% or less by volume per the entire thermal spray coating. The average pore diameter is more preferably 5 μm or less, and the porosity is more preferably 4% or less by volume. Particularly when a nitriding treatment is conducted after the formation of the thermal spray coating, the porosity of the thermal spray coating is preferably 1.5% or less by volume, to prevent a brittle nitride layer from being formed on a substrate surface in contact with the thermal spray coating, which leads to decrease in the adhesion of the thermal spray coating.

(3) Other Components

Because ceramic powders such as WC, etc. have high melting points and high hardness, they may be added to improve wear resistance. The ceramic powders may be added to any of the first and second thermal spray coatings. In the case of the second thermal spray coating, the ceramic powders may be added to any of the first and second phases.

(4) Surface Roughness of Thermal Spray Coating

To prevent the wear of a mating member such as a cylinder liner by sliding, the piston ring in sliding contact with the mating member preferably has as smooth a sliding surface as possible. Accordingly, the sliding surfaces of the first and second thermal spray coatings preferably have a surface roughness (10-point average roughness Rz) of 4 μm or less. When the surface roughness (10-point average roughness Rz) exceeds 4 μm, the attackability on the mating member becomes larger.

[2] Production Method (A) Pretreatment

A piston ring, on which a thermal spray coating is formed, may be subjected to a pretreatment, if necessary. For instance, a piston ring substrate may be subjected to a surface treatment such as a nitriding treatment, etc. Also, to improve the adhesion of the piston ring substrate to a thermal spray coating, the piston ring substrate may be blasted or washed. Particularly, the piston ring substrate is preferably provided with surface roughness of about 10 to 30 μm by shot blasting. This enables a thermal spray material impinging on projections of the substrate to locally melt the projections to form an alloy, thereby strongly adhering the thermal spray coating to the substrate. Further, it is preferable to preheat the substrate to about 100° C. and then clean the substrate surface with flame by a high-velocity flame spraying apparatus immediately before thermal spraying. This activates the substrate surface, thereby achieving the strong adhesion of the thermal spray coating to the substrate.

(B) Thermal Spray Powder (1) Powder for First Thermal Spray Coating

The first thermal spray coating is formed by a composite powder comprising chromium carbide particles having an average particle size of 5 μm or less dispersed in a matrix metal composed of a Ni—Cr alloy or a Ni—Cr alloy and Ni, both being strongly and chemically stably bonded to each other. The chemically stable, strong bonding between chromium carbide particles and a Ni—Cr alloy (or a Ni—Cr alloy and Ni) is preferable to prevent the coarsening or melting of the Ni—Cr alloy by the chromium carbide particles. If otherwise, the Ni—Cr alloy is coarsened or melted by thermal spraying to become large flat shape, resulting in difficulty in forming the thermal spray coating having a homogeneous microstructure. Such composite powder may be rapidly solidified fine powder, or granulated sintered powder described, for instance, in JP 10-110206 A and JP 11-350102 A.

In the composite powder produced from a melt containing Cr, Ni and C (for instance, a melt of metal Cr, metal Ni and pure C, or a melt of chromium carbides and a Ni—Cr alloy) by a rapid solidification method, crystallized chromium carbide particles on the order of microns are dispersed in the Ni—Cr alloy. The composite powder formed by a rapid solidification method is substantially spherical shape without pores, and the chromium carbide particles show dendritic or non-equiaxial structures, which are formed by the solidification.

Though not restrictive, the rapid solidification method may be a water atomization method, a gas atomization method, a rotating disc method, etc. The rapid solidification of a melt of chromium carbide and a Ni—Cr alloy causes fine chromium carbide particles to be uniformly crystallized in the matrix. With properly selected rapid solidification conditions, the particle sizes of crystallized chromium carbide particles can be controlled.

The granulated sintered powder may be produced by known methods. For instance, a starting material powder comprising chromium carbide particles and a Ni—Cr alloy powder (or a Ni—Cr alloy powder and Ni powder) is mixed with a binder, granulated to powder of a prescribed particle size by a granulating apparatus, and then sintered. The granulating method may be a spray-drying granulating method, compression granulating method, pulverization granulating method, etc.

(2) Powder for Second Thermal Spray Coating

The powder for the second thermal spray coating is a mixed powder comprising composite powder having chromium carbide particles dispersed in a matrix metal composed of a Ni—Cr alloy or a Ni—Cr alloy and Ni, and powder of at least one metal selected from the group consisting of Fe, Mo, Ni, Cr and Co or an alloy containing the metal. This composite powder may be the same as the composite powder used for the first thermal spray coating. Accordingly, it may be produced by the above-mentioned rapid solidification method or the granulating and sintering method.

The composite powder and the metal or alloy powder for the second phase are uniformly mixed to provide a thermal spray powder. The ratio of the composite powder to the metal or alloy powder for the second phase is set such that the area ratio of the first phase obtained from the composite powder is preferably 60 to 95%, more preferably 70 to 90%, as described above.

(C) Thermal Spraying Method

To enhance wear resistance and scuffing resistance while keeping little attackability on a mating member, it is necessary to form the thermal spray coating without making it coarser. For this purpose, such a method as a plasma-spraying method, by which a material powder is melted, is not appropriate, but a method capable of conducting thermal spraying at relatively low temperatures is preferable. Preferred thermal spraying methods are high-velocity flame spraying methods such as a high-velocity oxygen fuel (HVOF) spraying method, a high-velocity air fuel (HVAF) spraying method, etc. Among them, the high-velocity oxygen fuel spraying method is particularly preferable. A higher flame speed is preferable, and it is preferably 1200 m/second or more, more preferably 2000 m/second or more. The speed of the thermal spray powder is preferably 200 m/second or more, more preferably 500 m/second or more, most preferably 700 m/second or more.

The thickness of the thermal spray coating formed on an outer peripheral surface of the piston ring is usually 50 to 500 μm, preferably 100 to 300 μm. When the thickness of the thermal spray coating is less than 50 μm, the piston ring fails to have a predetermined life. On the other hand, when it exceeds 500 μm, the thermal spray coating easily peels off from the piston ring substrate.

(D) Finish Working

After the formation of the thermal spray coating, the piston ring is machined to a predetermined size. For instance, the outer peripheral surface of the piston ring is preferably ground by a polynoid grinding wheel of high-purity, abrasive alumina grains having a particle size of #100, and finally lapped by abrasive SiC grains having a particle size of #4000 for 90 seconds, to provide the sliding surface with a surface roughness (10-point average roughness Rz) of 4 μm or less.

The present invention will be explained in further detail referring to Examples below without intention of restricting the present invention thereto.

EXAMPLE 1

(1) Test Piece

A rectangular prism body of 5 mm in height, 5 mm in width and 20 mm in length was produced from the same spheroidal graphite cast iron (FCD600) as in a piston ring substrate, and one of its end surfaces (5 mm×5 mm) was ground to a curved surface having a radius of curvature R of 10 mm. This curved surface was blasted with #30 alumina particles to a surface roughness (10-point average roughness Rz) of 20 μm, to provide a test piece substrate. Rapidly solidified fine particles ("Sulzer Metco 5241," available from Sulzer Metco) were used as thermal spray powder.

Figure 3:
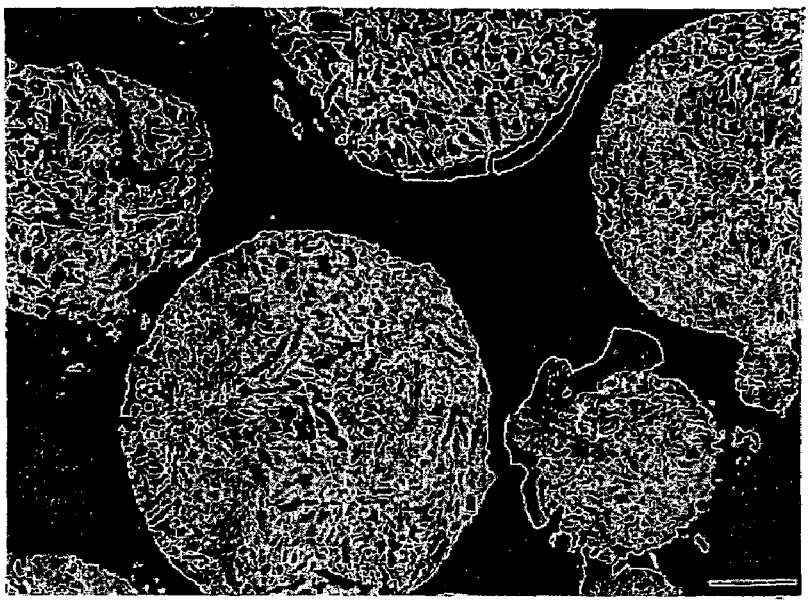
FIG. 3 is a scanning electron photomicrograph (×1000) showing rapidly solidified fine particulates used for thermal spraying in Example 1.

Sulzer Metco 5241 is fine particles which are obtained by melting a material having a composition of Cr:Ni:C=54:39:7 (% by mass) and rapidly solidifying the melt, with Cr and C forming chromium carbide and Ni and Cr forming a Ni—Cr alloy by melting and rapid solidification. Namely, Sulzer Metco 5241 has a structure in which crystallized chromium carbide particles are dispersed in a Ni—Cr alloy. FIG. 3 is a scanning electron photomicrograph (×1000) showing this thermal spray powder.

A test piece substrate was preheated to 100° C. and subjected to a surface activation treatment by high-velocity flame from a DJ1000 HVOF spraying gun available from Sulzer Metco, immediately before thermal spraying. A high-velocity flame spraying was then conducted at a flame speed of 1400 m/second and a particle speed of 600 m/second by the DJ1000 HVOF spraying gun, to form a thermal spray coating having a thickness of 300 μm on the curved surface of the test piece substrate. The thermal spray coating was finish-worked by grinding and lapping to provide a test piece. The thermal spray coating on the test piece had a surface roughness (10-point average roughness Rz) of 1.56 μm.

(2) Wear Test

Figure 4:
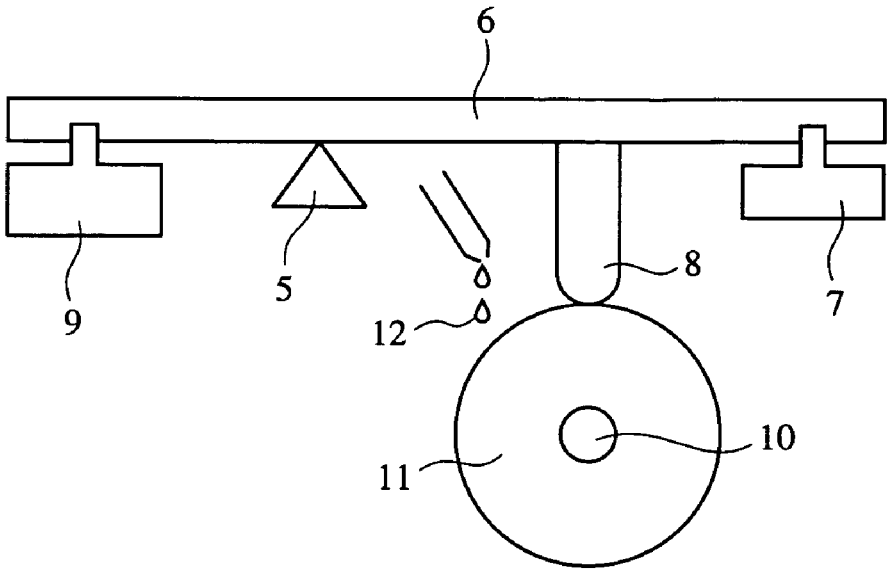
FIG. 4 is a schematic view showing a Kaken-type wear tester.

The thermal spray coating of the test piece was subjected to a wear test by a Kaken-type wear tester shown in FIG. 4, using as a mating member a drum (outer diameter: 80 mm, length: 300 mm) made of the same cast iron (FC250) as in a cylinder liner.

The wear tester comprises a rotatable drum 11, an arm 6 for pressing a test piece 8 sliding on an outer peripheral surface of the drum 11 onto the drum 11, a weight 7 mounted to one end of the arm 6, a balancer 9 mounted to the other end of the arm 6, and a fulcrum 5 for supporting the arm 6 between the test piece 8 and the balancer 9. The drum 11 rotates at a predetermined speed by a driving means (not shown), and contains a heater 10 so that it is adjusted to a desired temperature. The drum 11 is in sliding contact with the thermal spray coating having a curved surface on the test piece 8. This wear tester has such a structure that a lubricating oil 12 is poured onto a portion in which the drum 11 and the test piece 8 are in sliding contact with each other. The force of the arm 6 pressing the test piece 8 onto the drum 11 (contact surface pressure of the test piece 8 onto the drum 11) is changed by adjusting the weight 7.

The wear test conditions were as follows:

| | |
|---|---|
| Temperature of drum 11: | 80° C., |
| Weight 7: | 50 kg, |
| Rotation speed of drum 11: | 0.5 m/second, and |
| Test time: | 240 minutes. |

To place a sliding contact portion between the drum 11 and the test piece 8 in a corrosive environment, an $H_2SO_4$ solution of pH 2 was dropped at a rate of 1.5 $cm^3$/minute in place of the lubricating oil. As a result, the test piece 8 corresponding to the piston ring wore by 0.9 μm, verifying that it had a good wear resistance. Also, the drum 11 corresponding to the cylinder liner wore by relatively as small as 7.8 μm, verifying that it had little attackability on the mating member.

A thermal spray coating on the test piece 8 produced in the same manner as above was mirror-polished, and its microstructure was observed by a scanning electron microscope. FIG. 5 is a scanning electron photomicrograph (×1000) showing the microstructure of the thermal spray coating. The thermal spray coating contained a chromium carbide phase (dark gray) and a Ni—Cr alloy phase (bright gray), with extremely fine chromium carbide particles dispersed in the Ni—Cr alloy phase. Incidentally, black portions are pores. It is clear from the particle sizes of chromium carbide particles in the thermal spray coating that the sizes of chromium carbide particles in the thermal spray powder remained substantially unchanged. Also, fine chromium carbide particles in the thermal spray coating were dendritic or non-equiaxial. This is peculiar to a rapidly solidified structure.

The area ratio of pores to a total area (100%) of the thermal spray coating was 3% (thus porosity of 3% by volume), and the average diameter of pores was 4 μm. The chromium carbide particles had an area ratio of 75% in a portion of the thermal spray coating excluding pores, and an average particle size of 2 μm.

Figure 6:
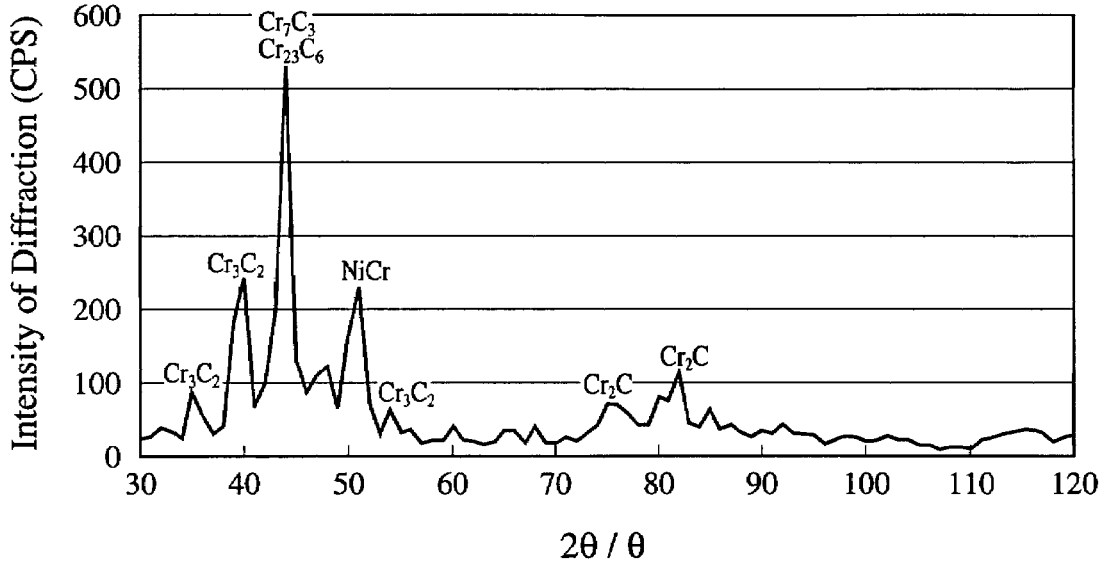
FIG. 6 is an X-ray diffraction profile of the thermal spray coating in Example 1.

FIG. 6 shows an X-ray diffraction profile of the thermal spray coating. It is clear from FIG. 6 that the chromium carbide particles in the thermal spray coating were $Cr_2C$, $Cr_3C_2$, $Cr_7C_3$ and $Cr_{23}C_6$.

The hardness of the thermal spray coating was measured at 20 randomly selected points under a load of 100 g, using a Vickers hardness tester (MVK-G2 available from Akashi Corporation). As a result, it was found that the thermal spray coating had an average hardness of 843 Hv0.1 with its standard deviation of 150 Hv0.1.

COMPARATIVE EXAMPLE 1

A thermal spray coating was produced in the same manner as in Example 1 except for using a mixed powder (particle size: under 325 mesh) of 75% by mass of $Cr_3C_2$ powder and 25% by mass of a Ni—Cr alloy powder as a thermal spray powder. The finished thermal spray coating had a surface roughness (10-point average roughness Rz) of 6.2 μm.

Figure 7:
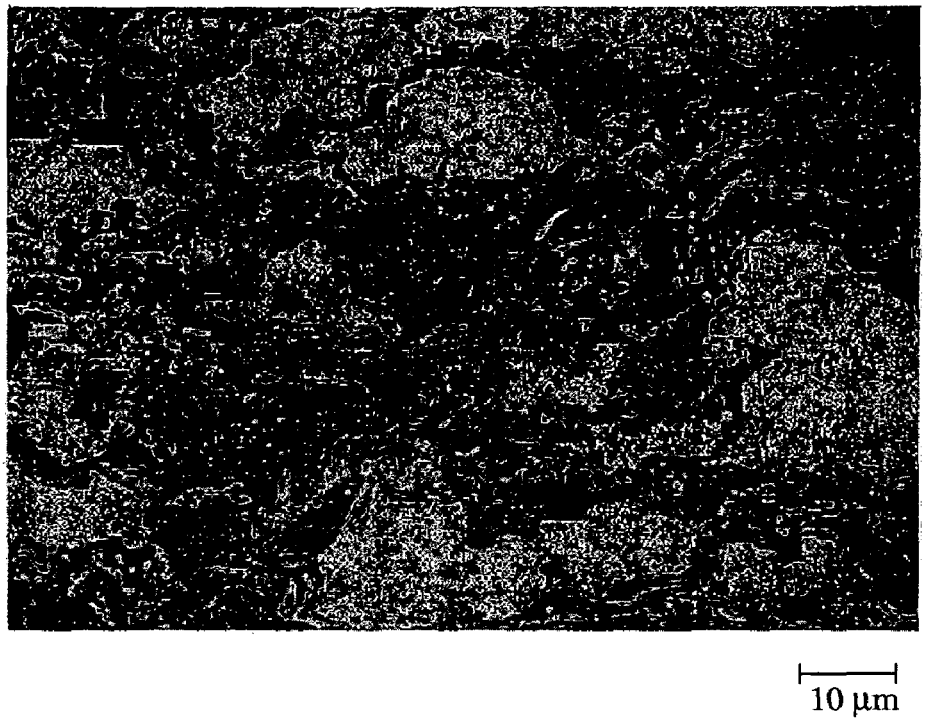
FIG. 7 is a scanning electron photomicrograph (×1000) showing the microstructure of the thermal spray coating in Comparative Example 1.

FIG. 7 is a scanning electron photomicrograph showing the microstructure of the thermal spray coating. Almost all chromium carbide particles exceeded 10 μm, and many Ni—Cr alloy particles were large flat particles exceeding 30 μm. The area ratio of pores in the thermal spray coating was 2% (thus porosity of 2% by volume), and the area ratio of chromium carbide particles in a portion of the thermal spray coating excluding pores was 50%. The average hardness of the thermal spray coating measured in the same manner as in Example 1 was 702 Hv0.1, with its standard deviation of 220 Hv0.1.

The same wear test as in Example 1 indicated that a test piece 8 corresponding to a piston ring wore relatively as little as 1.8 μm, while a drum 11 corresponding to a cylinder liner wore as much as 15.5 μm.

EXAMPLE 2

A test piece corresponding to a piston ring was produced in the same manner as in Example 1, except for using as a thermal spraying powder CRC-410 (mass ratio of chromium carbide particles: Ni—Cr alloy=70:30, available from Praxair Technology, Inc.) produced by a rapid solidification method. The finished thermal spray coating had a surface roughness (10-point average roughness Rz) of 2.64 μm.

Pores in the thermal spray coating had an area ratio of 5% (thus porosity of 5% by volume) and an average diameter of 3 μm. The chromium carbide particles in a portion of the thermal spray coating excluding pores had an area ratio of 63% and an average particle size of 2.8 μm. The chromium carbide particles had dendritic and non-equiaxial shapes peculiar to solidified structures as in Example 1. The hardness of the thermal spray coating measured in the same manner as in Example 1 was 815 Hv0.1 on average, with its standard deviation of 142 Hv0.1.

The same wear test as in Example 1 indicated that a test piece corresponding to a piston ring wore as little as 1.0 μm, and a drum corresponding to a cylinder liner wore relatively as little as 8.0 μm. This verified that the piston ring having a thermal spray coating in this Example had little attackability on a mating member.

EXAMPLE 3

Figure 8:
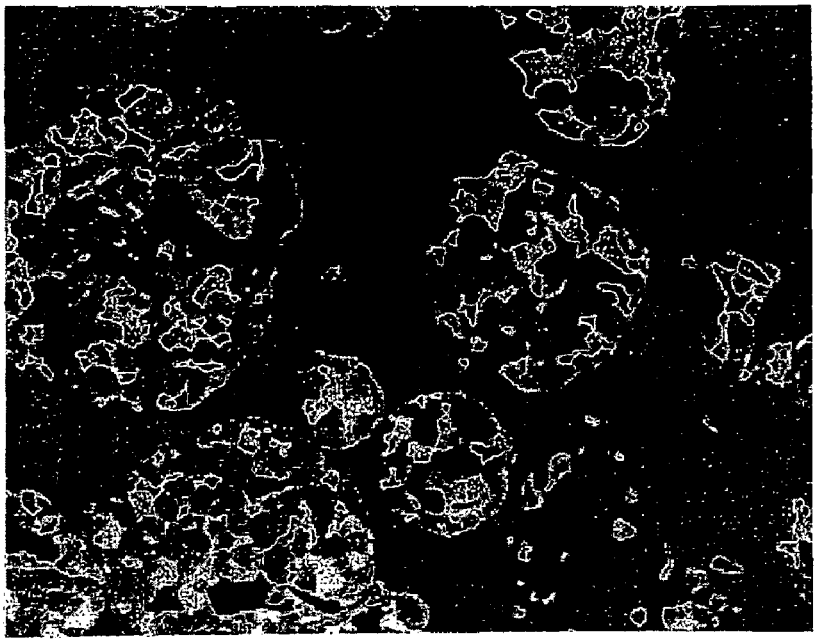
FIG. 8 is a scanning electron photomicrograph (×1000) showing granulated sintered composite powder used in Example 3.

100 parts by mass of a mixed powder of 75% by mass of chromium carbide particles having an average particle size of 3.6 μm and 25% by mass of a Ni—Cr alloy powder (mass ratio of Ni/Cr=80/20) having an average particle size of 4.5 μm was mixed with 15 parts by mass of polyvinyl alcohol as a binder, granulated by spray drying, classified, and sintered at 800° C., to produce a granulated and sintered powder of chromium carbide particles/Ni—Cr alloy powder shown in FIG. 8. The granulated and sintered powder had a particle size under 325 mesh.

A curved surface of a rectangular prism body made of the same spheroidal graphite cast iron (FCD600) as in Example 1 was blasted and subjected to an activation treatment in the same manner as in Example 1 immediately before thermal spraying. Using an HVAF spraying gun (available from Intelli-Jet), the high-velocity flame spraying of the above granulated and sintered powder was conducted onto a curved surface of the rectangular prism body at a flame speed of 2100 m/second and at a particle speed of 800 m/second, to form a thermal spray coating having a thickness of 300 μm. After finish-working in the same manner as in Example 1, the thermal spray coating had a surface roughness (10-point average roughness Rz) of 3.4 μm.

FIG. 9 is a scanning electron photomicrograph showing the microstructure of the thermal spray coating. Chromium carbide particles had an average particle size of 4.2 μm, and almost all the chromium carbide particles had particle sizes of 5 μm or less. With extremely fine pores only sparsely existing in the Ni—Cr alloy matrix, the thermal spray coating had an extremely dense structure. The area ratio of pores in the thermal spray coating was 1.5% (thus porosity of 1.5% by volume), and the average diameter of pores was 0.8 μm. The area ratio of the chromium carbide particles in a portion of the thermal spray coating excluding pores was 85%. Unlike Examples 1 and 2, relatively many chromium carbide particles had equiaxial shapes. The hardness of the thermal spray coating measured in the same manner as in Example 1 was 960 Hv0.1 on average, with its standard deviation of 93 Hv0.1.

The same wear test as in Example 1 indicated that a test piece corresponding to a piston ring wore as little as 1.6 μm, and a drum corresponding to a cylinder liner also wore relatively as little as 8.4 μm. This verified that the piston ring having a thermal spray coating in this Example had little attackability on a mating member.

EXAMPLE 4

A cylindrical member (outer diameter: 320 mm, inner diameter: 284 mm) made of SUS440C was heat-treated, roughly worked (machined) to a cam shape of 316 mm in longer diameter and 310 mm in shorter diameter, cut to a width of 6 mm, and further partially cut to provide a piston ring with a gap. The piston ring was provided with a circumferential groove having a width of 4.2 mm and a depth of 0.3 mm in a center of its peripheral surface.

Four grooved piston rings thus produced were fixed to a jig with their gaps closed, and the outer peripheral surface of each piston ring was blasted in the same manner as in Example 1. The high-velocity flame spraying of the same thermal spraying powder as in Example 1 was conducted on the peripheral surface of each piston ring under the conditions that the revolution speed of the piston ring was 30 rpm, and that the moving speed of the thermal spraying gun was 15 mm/minute, to form a thermal spray coating in the groove of the piston ring on its outer peripheral surface. The outer peripheral surface of the piston ring was finished in the same manner as in Example 1, to obtain piston rings each having a good peripheral surface without steps on the edges of the inlaid groove.

EXAMPLE 5

A mixed powder comprising a composite powder having chromium carbide particles dispersed in a Ni—Cr alloy (Sulzer Metco 5241 available from Sulzer Metco), and a metal or alloy powder for a second phase shown in Table 1 was thermally sprayed onto an outer peripheral surface of each piston ring made of spheroidal graphite cast iron, which had an outer diameter of 120 mm, a thickness of 3.5 mm and a width of 4.4 mm, by an HVOF method at a flame speed of 1400 m/second and at a particle speed of 300 m/second, using a DJ1000 HVOF spraying gun available from Sulzer Metco, thereby producing a full-face piston ring. A mixing ratio of a composite powder and a metal or alloy powder for a second phase was set in each Sample 1 to 7 such that the area ratio of the second phase to a portion of the thermal spray coating excluding pores was 5%.

Full-face piston rings each having a thermal spray coating were also produced in the same manner as above except for changing the area ratio of the second phase to 15%, 25%, 35%, 45% and 55%, respectively, in each Sample 1 to 7. Further, in Sample 8, a thermal spray coating made only of the same Sulzer Metco 5241 powder available from Sulzer Metco as in Example 1 was formed on the outer peripheral surface of each piston ring. The thermal spray coating in each Sample 1 to 8 was ground to a thickness of 150 μm by a CBN grinding wheel.

TABLE 1

| Sample | Metal or Alloy Powder for Second Phase | |
|---|---|---|
| No. | Tradename | Composition[1] |
| 1 | Diamalloy 4008NS[1] | $Ni_{bal}Al_5$ |
| 2 | Metco 43F-NS[1] | $Ni_{bal}Cr_{20}$ |
| 3 | 1260F[2] | $Ni_{bal}Cr_{50}$ |
| 4 | Diamalloy 1003[1] | $Fe_{bal}Cr_{17}Ni_{12}Mo_{2.5}Si_1C_{0.1}$ |
| 5 | Metco 63NS[1] | Mo[3] |
| 6 | Diamalloy 1004[1] | $Cu_{bal}Al_{9.5}Fe_1$ |
| 7 | Diamalloy 3001[1] | $Co_{bal}Mo_{28}Cr_{17}Si_3$ |

Note:
[1]Available from Sulzer Metco.
[2]Available from Praxair, Inc.
[3]Purity: 99%.

Figure 10:
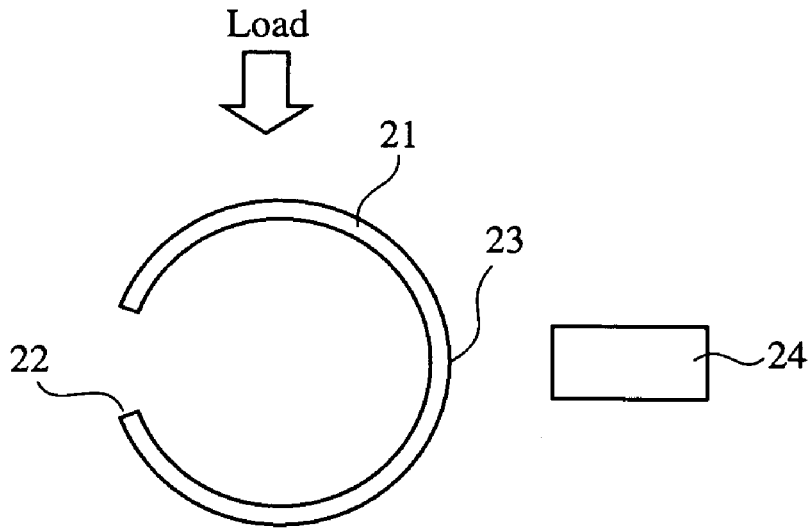
FIG. 10 is a schematic view showing an M-closing test.
Figure 11:
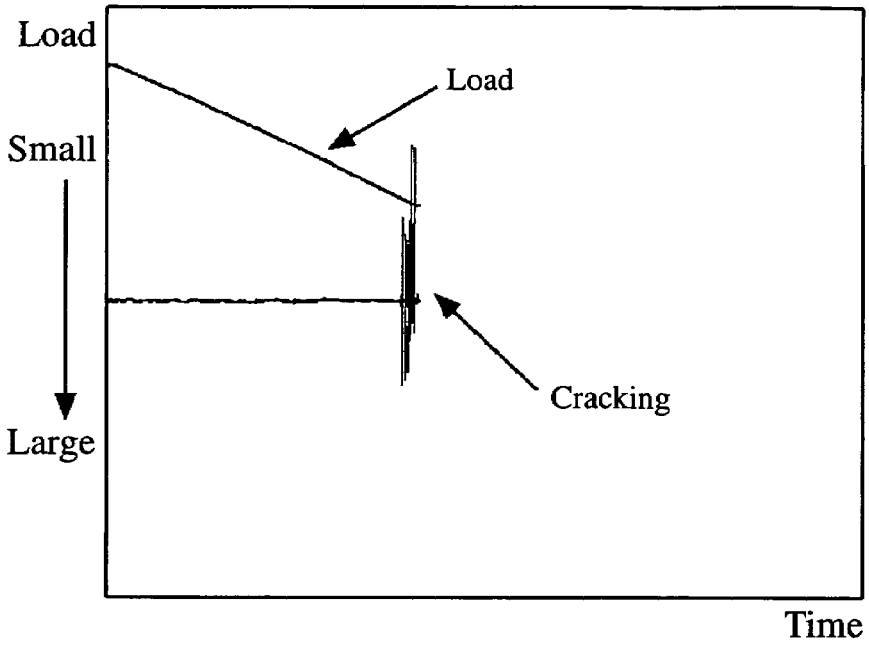
FIG. 11 is a graph showing the results of the M-closing test of Sample 8 in Example 5.
Figure 12:
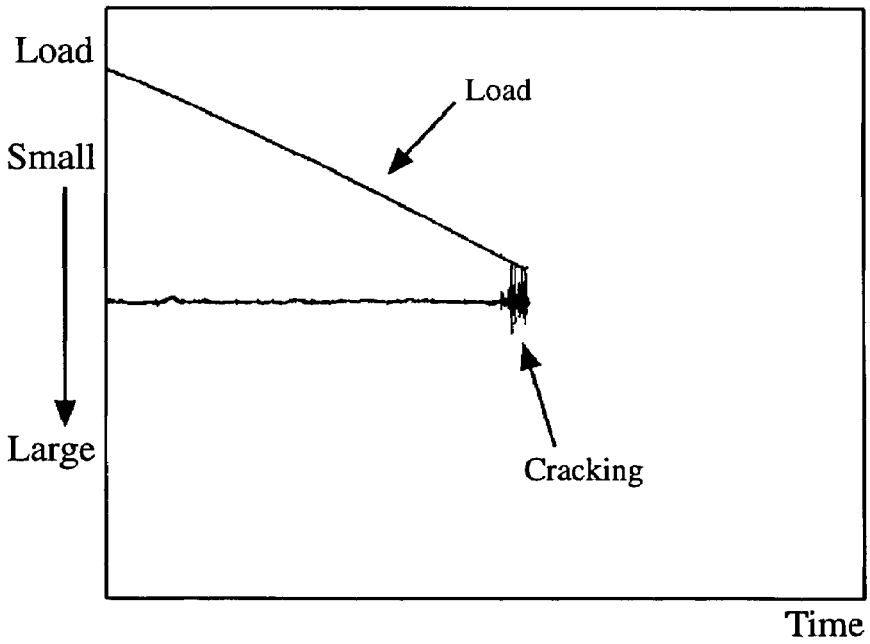
FIG. 12 is a graph showing the results of the M-closing test of Sample 3 (area ratio of second phase: 35%) in Example 5.

The thermal spray coating of each piston ring was evaluated with respect to a bonding strength between particles by an M-closing test. In the M-closing test with a gap 22 oriented in a horizontal direction, as shown in FIG. 10, a load applied to the piston ring 21 from above was continuously increased to measure the load when a cracking is occurred in a coating portion 23 on the 180°-opposite side of the gap 22. The M-closing test is carried out with part of gap-end portions cut off such that the gap-end portions do not abut before cracking occurs. The cracking was detected by an AE sensor 24. The thermal spray coating that is cracked at a high load is excellent in the bonding strength between particles. The measurement results are shown in Table 2. FIG. 11 shows the relation between a load and cracking in Sample 8, and FIG. 12 shows the relation between a load and cracking in Sample 3 (the area ratio of the second phase: 35%).

TABLE 2

| Sample | Load (MPa) When Cracking Occurred | | | | | |
|---|---|---|---|---|---|---|
| No. | 5%(1) | 15%(1) | 25%(1) | 35%(1) | 45%(1) | 55%(1) |
| 1 | 596 | 656 | 719 | 783 | 834 | 898 |
| 2 | 611 | 685 | 767 | 845 | 920 | 996 |
| 3 | 595 | 657 | 705 | 762 | 809 | 861 |
| 4 | 598 | 662 | 725 | 786 | 840 | 903 |
| 5 | 591 | 640 | 693 | 733 | 785 | 810 |
| 6 | 614 | 688 | 775 | 864 | 923 | 990 |
| 7 | 605 | 672 | 733 | 805 | 862 | 927 |
| 8 | | | | 543 | | |

Note:
(1)The area ratio of the second phase in a portion of the thermal spray coating excluding pores.

As is clear from Table 2, the load at which cracking occurred in the thermal spray coating was 543 MPa in Sample 8 made only of Sulzer Metco 5241, while it was as high as 591 MPa at the lowest (Sample 5 having Mo area ratio of 5%) in Samples 1 to 7 made of a mixed powder of Sulzer Metco 5241 powder and a metal or alloy powder for a second phase. Any of Samples 1 to 7 had improved bonding strength between particles, exhibiting high capability of preventing cracking and the debonding of particles. Though the load at cracking becomes higher as the area ratio of the second phase increases, an insufficient content of the first phase (composite powder) results in a decreased wear resistance. Accordingly, the area ratio of the first phase is preferably 60% to 95%.

What is claimed is:

1. A piston ring comprising a thermal spray coating at least on an outer peripheral surface, which is combined with a cylinder liner of cast iron having a tensile strength of 300 MPa or less, said thermal spray coating comprising chromium carbide particles having an average particle size of 5 μm or less dispersed in a matrix metal composed of a Ni—Cr alloy or a Ni—Cr alloy and Ni, which has an average pore diameter of 10 μm or less and a porosity of 8% or less by volume.

2. The piston ring according to claim 1, wherein said thermal spray coating has a Vickers hardness of 700 Hv0.1 or more on average, and the standard deviation of said hardness is less than 200 Hv0.1.

3. The piston ring according to claim 1, wherein said chromium carbide particles of said thermal spray coating have an average particle size of 3 μm or less.

4. The piston ring according to claim 1, wherein said thermal spray coating has an average pore diameter of 5 μm or less and a porosity of 4% or less by volume.

5. The piston ring according to claim 1, wherein said thermal spray coating has a surface roughness (10-point average roughness Rz) of 4 μm or less.

6. The piston ring according to claim 1, wherein said chromium carbide particles of said thermal spray coating are dendritic and/or non-equiaxial.

7. A piston ring comprising a thermal spray coating at least on an outer peripheral surface, which is combined with a cylinder liner of cast iron having a tensile strength of 300 MPa or less, said thermal spray coating comprising (1) a first phase having chromium carbide particles dispersed in a matrix metal composed of a Ni—Cr alloy or a Ni—Cr alloy and Ni, and (2) a second phase composed of at least one metal selected from the group consisting of Fe, Mo, Ni, Co, Cr and Cu or an alloy containing said metal, said first phase existing more than said second phase, said thermal spray coating having an average pore diameter of 10 μm of less and a porosity of 8% or less by volume.

8. The piston ring according to claim 7, wherein an area ratio of said first phase to a surface portion excluding pores (100%) is 60% to 95% in said thermal spray coating.

9. The piston ring according to claim 7, wherein said chromium carbide particles of said thermal spray coating have an average particle size of 5 μm or less.

10. A method for producing a piston ring recited in claim 7, comprising thermally spraying a mixed powder of (a) a composite powder having said chromium carbide particles dispersed in said matrix metal, and (b) a metal or alloy powder forming said second phase, at least onto an outer peripheral surface of said piston ring.

11. A method for producing a piston ring comprising a thermal spray coating at least on an outer peripheral surface, which is combined with a cylinder liner of cast iron having a tensile strength of 300 MPa or less, said thermal spray coating comprising chromium carbide particles having an average particle size of 5 μm or less dispersed in a matrix metal composed of a Ni—Cr alloy or a Ni—Cr alloy and Ni, which has an average pore diameter of 10 μm or less and a porosity of 8% or less by volume, the method comprising thermally spraying a composite powder having said chromium carbide particles dispersed in said matrix metal, at least onto an outer peripheral surface of said piston ring.

12. The method according to claim 11, wherein said composite powder is obtained by rapidly solidifying a melt of said matrix metal containing said chromium carbide particles.

13. The method according to claim 11, wherein said composite powder is obtained by granulating and sintering said chromium carbide particles and said matrix metal particles.

14. The method according to claim 11, wherein said thermal spraying is conducted by a high-velocity oxygen fuel spraying method or a high-velocity air fuel spraying method.

* * * * *